US007159321B2

(12) United States Patent
Yeh

(10) Patent No.: US 7,159,321 B2
(45) Date of Patent: Jan. 9, 2007

(54) NOTCHED SINGLE-EDGE THINNING SCISSORS

(76) Inventor: Wen-Ya Yeh, 15F-2, No. 18, Chorng Shyue Road, Tainan City (TW)

( * ) Notice: Subject to any disclaimer, the term of this patent is extended or adjusted under 35 U.S.C. 154(b) by 0 days.

(21) Appl. No.: 10/932,823

(22) Filed: Sep. 1, 2004

(65) Prior Publication Data

US 2006/0042094 A1 Mar. 2, 2006

(51) Int. Cl.
*B26B 13/08* (2006.01)

(52) U.S. Cl. ..... 30/195; 36/233.5

(58) Field of Classification Search ..... 30/195, 30/254, 355, 357, 233.5
See application file for complete search history.

(56) References Cited

U.S. PATENT DOCUMENTS

| | | | | |
|---|---|---|---|---|
| 4,170,064 | A | 10/1979 | Senk | |
| 5,107,591 | A * | 4/1992 | Sato | 30/195 |
| 6,385,851 | B1 * | 5/2002 | Yeh | 30/195 |

FOREIGN PATENT DOCUMENTS

| | | | |
|---|---|---|---|
| DE | 85 13 958 | U1 | 7/1985 |
| DE | 36 03 036 | A1 | 8/1986 |
| EP | 1 153 712 | A1 | 11/2001 |
| EP | 1 640 123 | A1 * | 3/2006 |
| JP | 1981 56882 | U | 5/1981 |
| JP | 8-131666 | * | 5/1996 |
| JP | 9-308778 | * | 12/1997 |
| JP | 10-174788 | * | 6/1998 |
| JP | 10-216373 | * | 8/1998 |
| JP | 2002 360954 | A | 12/2002 |
| JP | 2003 290572 | A | 10/2003 |
| JP | 2003-340175 | * | 12/2003 |
| JP | 2004-41268 | * | 2/2004 |
| JP | 2005-66081 | A * | 3/2005 |
| JP | 2005-143528 | * | 6/2005 |
| JP | 2005-224419 | A * | 8/2005 |
| KR | 0173666 | | 3/2000 |

* cited by examiner

*Primary Examiner*—Hwei-Siu Payer
(74) *Attorney, Agent, or Firm*—Pro-Techtor Int'l Services

(57) ABSTRACT

A notched single-edge thinning scissors is disclosed to have chamfered edges formed in the notched blade between the hair contact side of the notched blade and the left sidewall, right sidewall and bottom wall of each notch, and between the cutting edges of the teeth of the notched blade and the left and right sidewalls of each notch for supporting the hair not to be cut during trimming.

2 Claims, 8 Drawing Sheets

NOTCHED SINGLE-EDGE THINNING SCISSORS

BACKGROUND OF THE INVENTION

1. Field of the Invention

The present invention relates to scissors and more particularly, to a notched single-edge thinning scissors that has rounded edges formed in the notched blades around the notches for supporting the hair not to be cut without causing damage to the hair not to be cut.

2. Description of the Related Art

A conventional notched single-edge thinning scissors A (see FIGS. 1 and 2) is comprised of a first scissors member 100 and a second scissors member 200 pivotally connected together with a pivot 300. The first scissors member 100 has a handle (ring handle) 101 at one end and a blade 102 at the other end. The blade 102 has a contact side 106, a distal side 107, and a notched edge formed of teeth 103 and notches 104. The width of the notches 104 is designed subject to the amount of the hair not to be cut during trimming (the design shown in FIG. 1 has relatively wider notches; the design shown in FIG. 2 has relatively narrow notched). Each tooth 103 has a cutting edge 105. The second scissors member 200 has a handle 201 at one end and a blade 202 at the other end. The blade 202 is a cutting blade having a cutting side 203 and a distal side 204 opposite to the cutting side 203. When closing the thinning scissors A, the cutting side 203 of the blade 202 of the second scissors member 200 is moved over the cutting edges 105 of the teeth 103 and the contact side 106 of the blade 102 of the first scissors member 100 to cut the hair. This design of notched 5 single-edge thinning scissors is still not satisfactory in function. Because the hair receiving areas (contact areas between the hair-not-to-be-cut and the scissor surfaces around the notches) between the contact side 106 and distal side 107 of the blade 102 and the left and right sidewalls and bottom walls of the notches 104 are aligned in line X (see FIGS. 3 and 4), the hair not to be cut may be jammed in line X, i.e., in the hair receiving areas between the contact side 106 and distal side 107 of the blade 102 and the left and right sidewalls and bottom walls of the notches 104 during trimming, thereby causing damage to the hair not to be cut.

SUMMARY OF THE INVENTION

The present invention has been accomplished under the circumstances in view. It is the main object of the present invention to provide a notched single-edge thinning scissors that eliminates the drawback of the aforesaid prior art design.

To achieve this and other objects of the present invention, the notched single-edge thinning scissors comprises a first scissors member and a second scissors member pivotally connected together with a pivot. The first scissors member and the second scissors member each have a handle at one end thereof and a blade at an opposite end thereof. The blade of the first scissors member has a contact side, a distal side opposite to the contact side, and a notched edge formed of teeth and notches. Each tooth has a cutting edge. The blade of the second scissors member has a cutting side and a distal side opposite to the cutting side. The notches of the blade of the first scissors member together with the leading edge of the blade of the second scissors member define a hair receiving space. Each notch has a left sidewall, a right sidewall, and a bottom wall. The contact side and distal side of the blade of the first scissors member each have first rounded edges, second rounded edges and third rounded edges respectively connected to the left sidewall, right sidewall and bottom wall of each notch. The blade of the first scissors member has a plurality of rounded edges formed in the hair receiving areas between the cutting edges and the left and right sidewalls of each notch.

DETAILED DESCRIPTION OF THE PREFERRED EMBODIMENT

Figure 1:
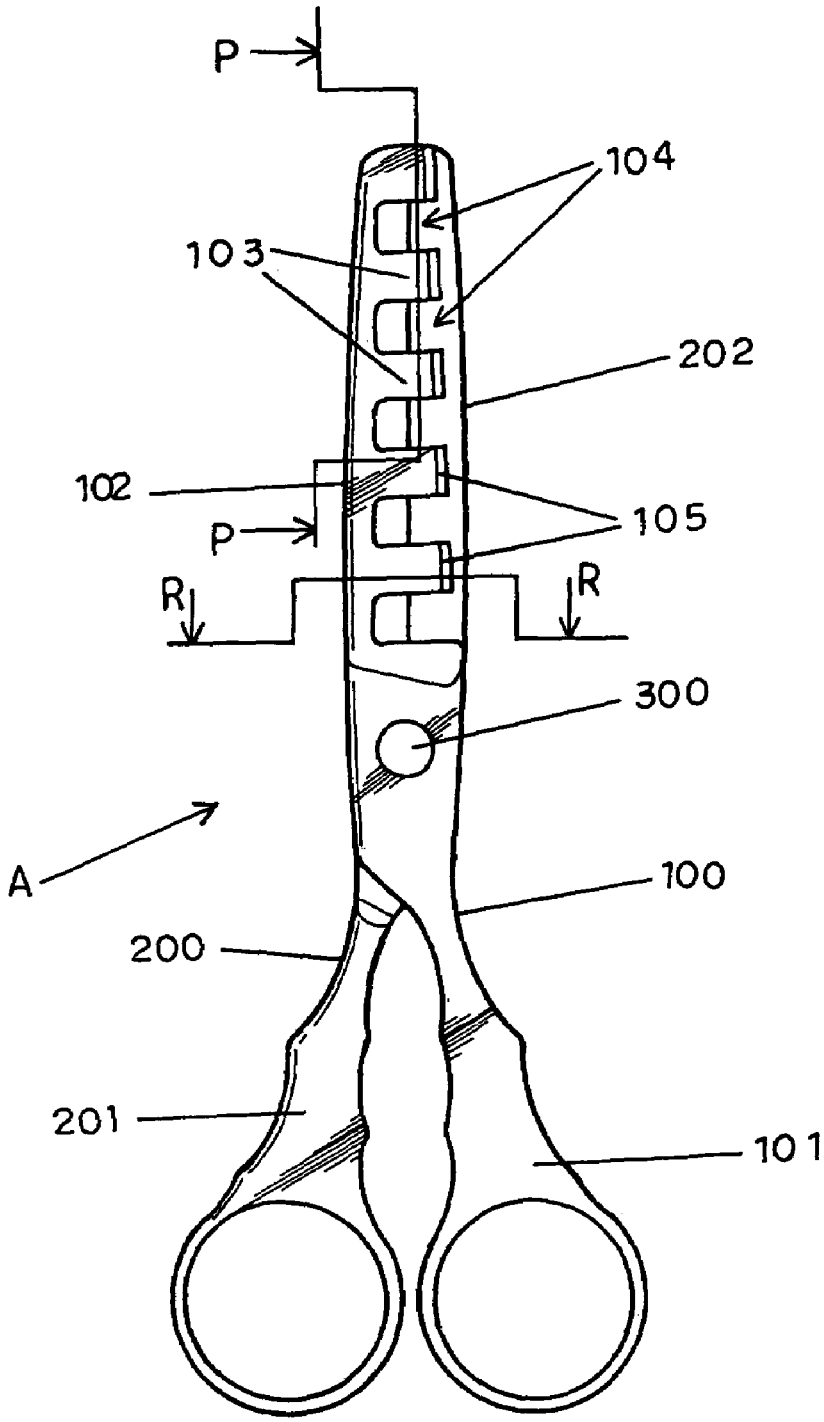
Fig.1 (Prior Art)
FIG. 1 is a plain view of a notched single-edge thinning scissors according to the prior art.
Figure 2:
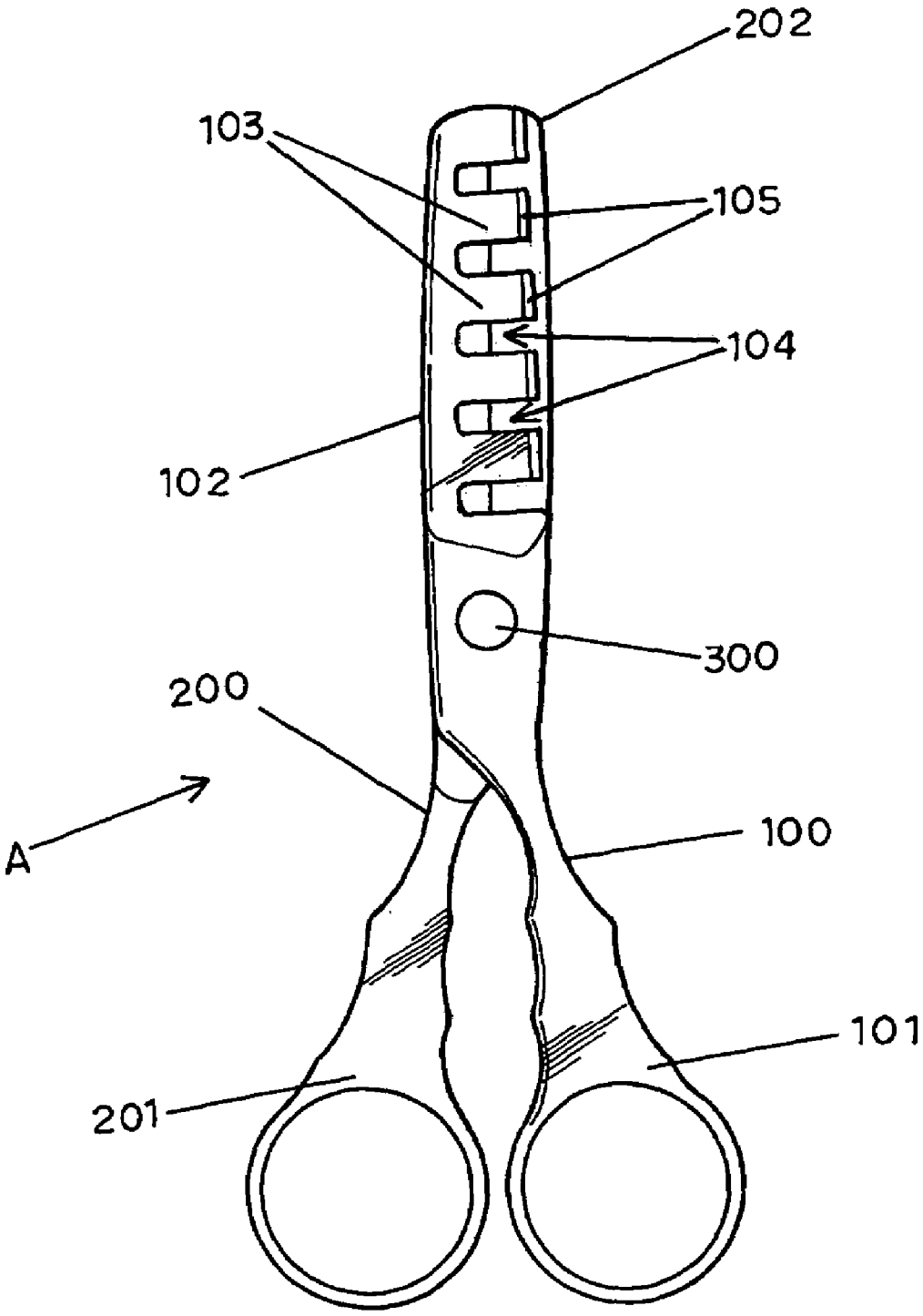
Fig.2(Prior Art)
FIG. 2 is a plain view of another notched single-edge thinning scissors according to the prior art.
Figure 4:
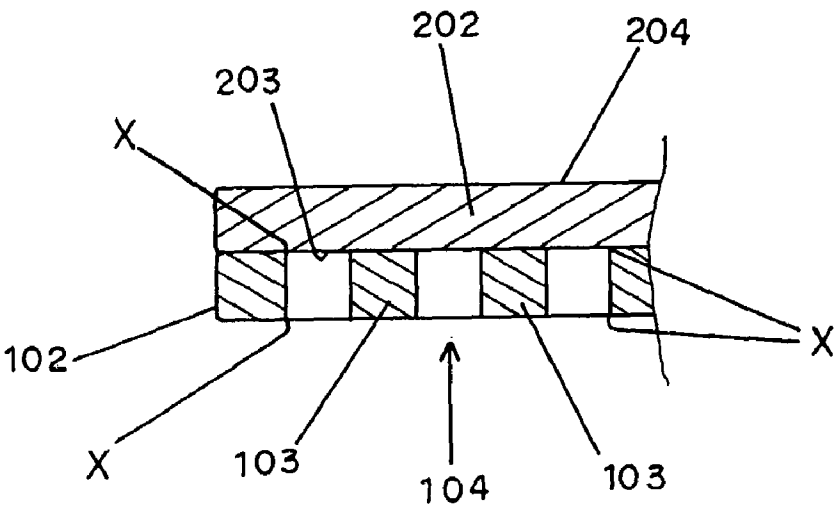
Fig.4(Prior Art)
FIG. 4 is a sectional view taken along line P—P of FIG. 1.
Figure 3:
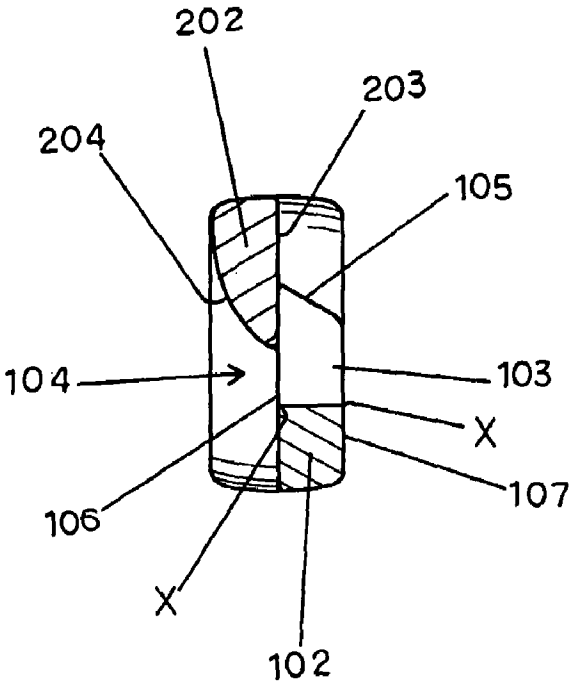
Fig.3(Prior Art)
FIG. 3 is a sectional view taken along line R—R of FIG. 1.
Figure 5:
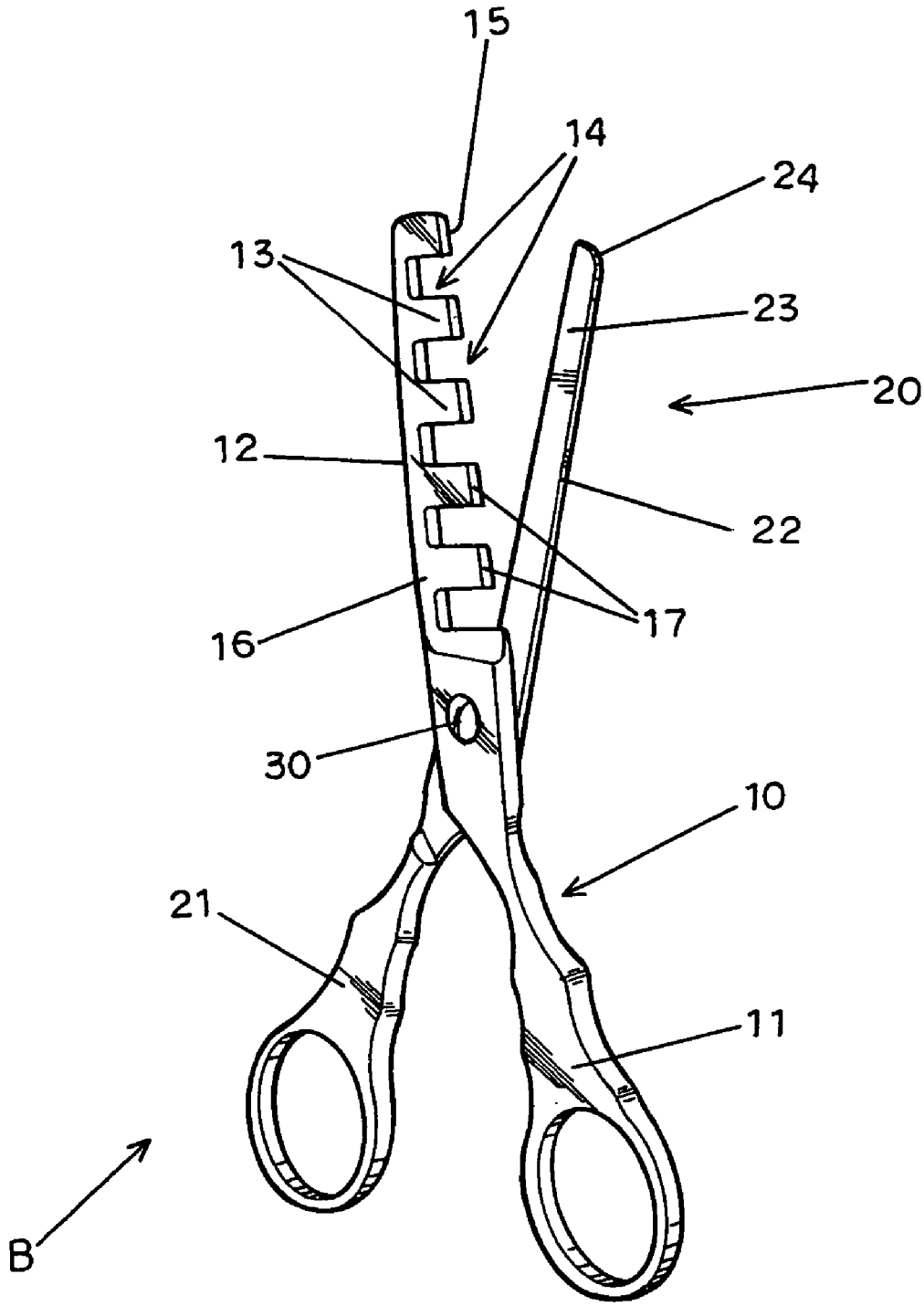
FIG. 5 is a perspective view of a notched single-edge thinning scissors according to the present invention.
Figure 6:
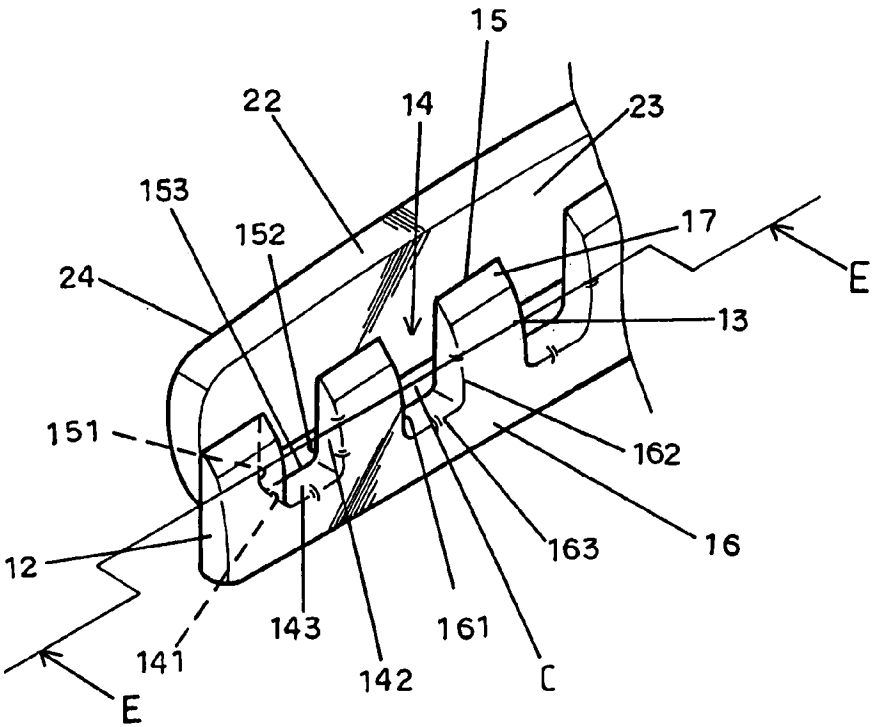
FIG. 6 is a perspective view in an enlarged scale a part of the present invention.
Figure 8:
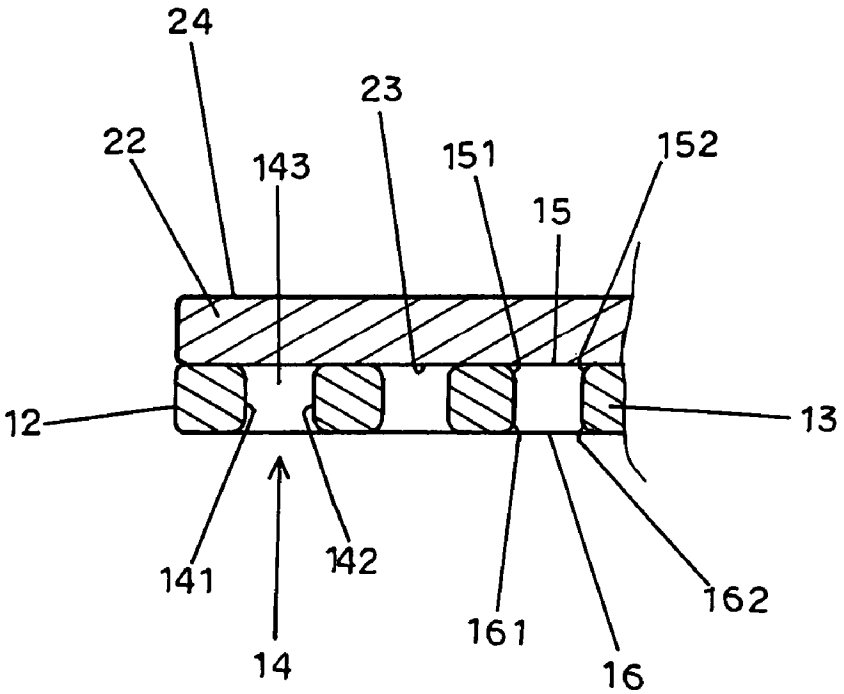
FIG. 8 is a sectional view taken along line E—E of FIG. 6.
Figure 7:
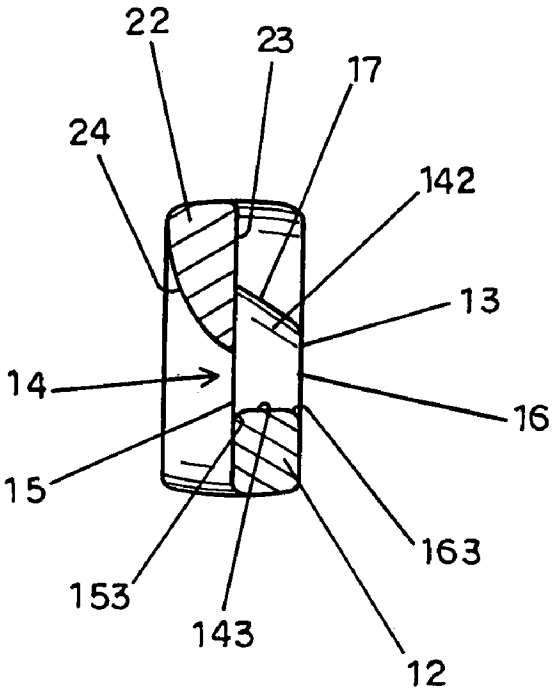
FIG. 7 is a sectional view taken along line F—F of FIG. 11.

Referring to FIGS. 5 and 6, a notched single-edge thinning scissors B in accordance with the present invention is shown comprised of a first scissors member 10 and a second scissors member 20 pivotally connected together with a pivot 30. The first scissors member 10 has a handle (ring handle) 11 at one end and a blade 12 at the other end. The blade 12 has a notched blade having a contact side 15, a distal side 16 opposite to the contact side 15, and a notched edge formed of teeth 13 and notches 14. The teeth 13 each have a cutting edge 17. The second scissors member 20 has a handle (ring handle) 21 at one end and a blade 22 at the other end. The blade 22 is a cutting blade having a cutting side 23 and a distal side 24 opposite to the cutting side 23. When closing the thinning scissors B, a hair receiving space C is defined between the notches 14 of the blade 12 of the first scissors member 10 and the leading edge of the blade 22 of the second scissors member 20 (see FIGS. 6 and 11). Each notch 14 has a left sidewall 141, a right sidewall 142, and a bottom wall 143. The contact side 15 of the blade 12 has a first rounded edges 151, second rounded edges 152 and third rounded edges 153 respectively connected to the left sidewall 141, right sidewall 142 and bottom wall 143 of each of the notches 14 (see FIG. 7). The distal side 16 of the blade 12 has a first rounded edges 161, second rounded edges 162 and third rounded edges 163 respectively connected to the left sidewall 141, right sidewall 142 and bottom wall 143 of each of the notches 14 (see FIG. 8). When closing the thinning scissors B, the cutting side 23 of the blade 22 of the second scissors member 20 is moved over the cutting edges 17 of the teeth 13 and the contact side 15 of the blade 12 of the first scissors member 10 to cut the hair (see FIG. 6).

Figure 10:
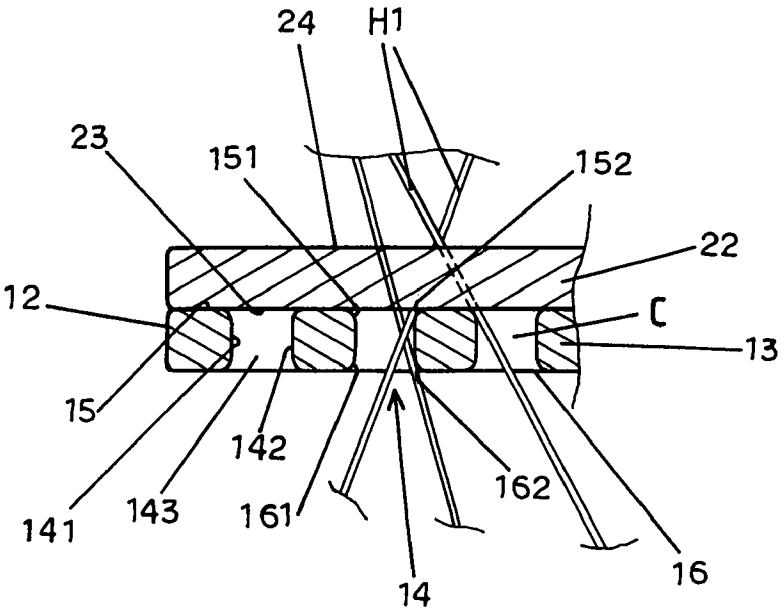
FIG. 10 is similar to FIG. 8 but showing the blades of the two scissors members moved relative to each other.
Figure 9:
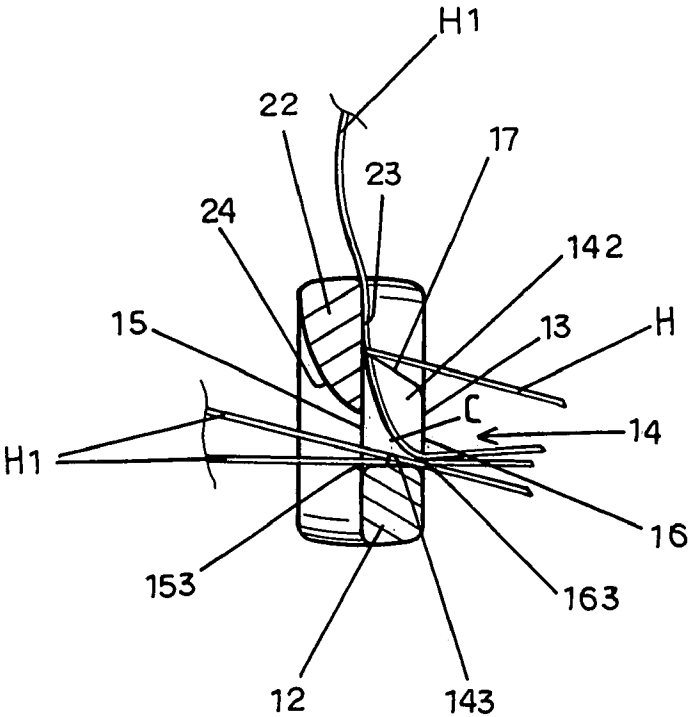
FIG. 9 is similar to FIG. 7 but showing the blades of the two scissors members moved relative to each other.

When trimming the hair, the blades 12, 22 of the two scissors members 10, 20 are moved relative to each other in proximity, and the cutting side 23 of the blade 22 of the second scissors member 20 repeatedly contacts the cutting edges 17 and the contact side 15, and therefore the cutting side 23 and the cutting edges 17 of the blade 12 of the first scissors member 10 work to cut the hair. The cut-off hair H falls along the cutting edges 17 (see FIG. 9). At this time, the notches 14 and the hair receiving space C receive the hair not to be cut H1. During trimming, the hair not to be cut H1 being received in the notches 14 and the hair receiving space C is maintained in "sliding" contact with the rounded edges 151–153 and the rounded edges 161–163, preventing damage (see FIGS. 9 and 10).

Figure 11:
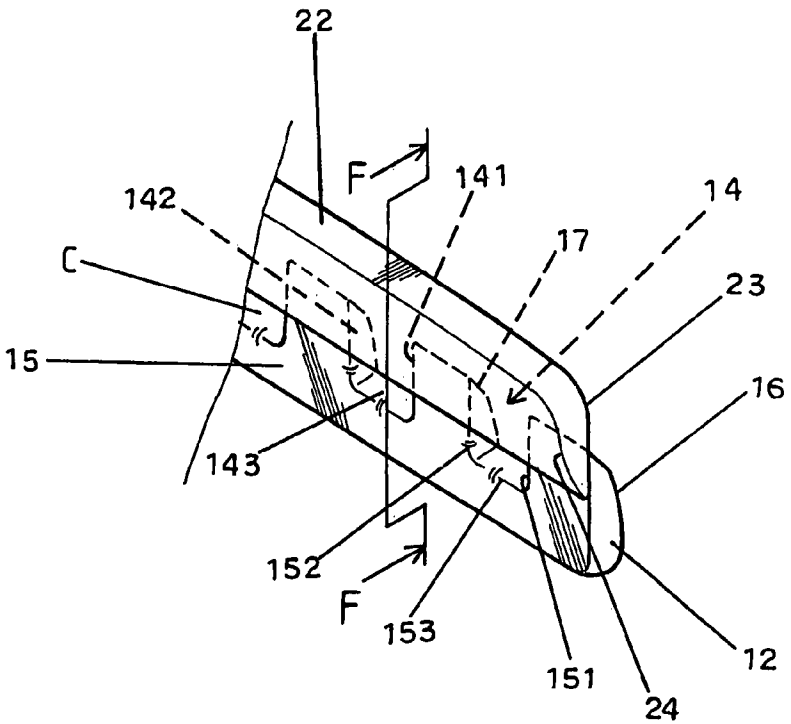
FIG. 11 corresponds to FIG. 6 but viewed from another side.
Figure 12:
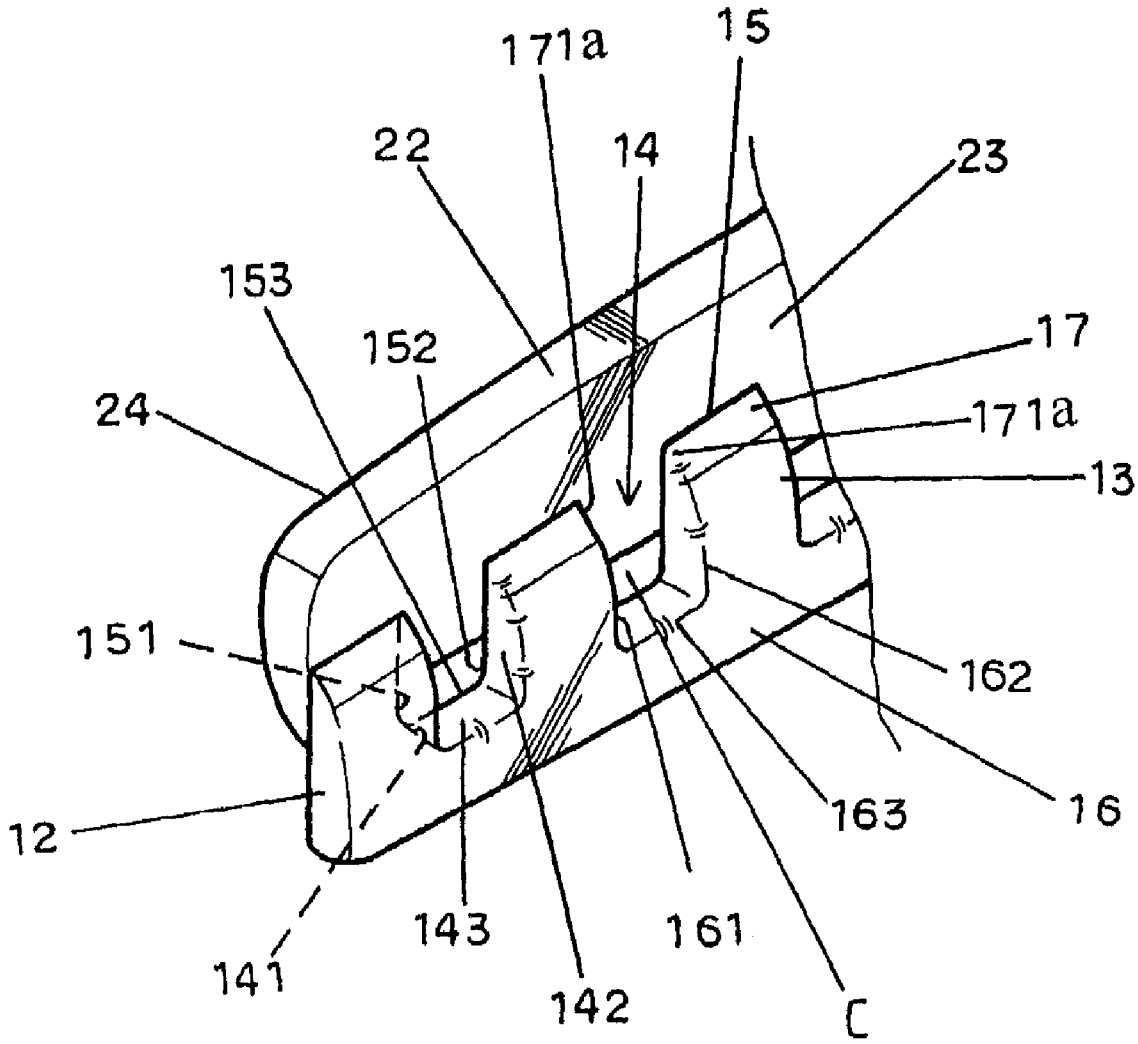
FIG. 12 is a perspective view in an enlarged scale of a part of the present invention showing rounded edges formed in the hair receiving areas between the cutting edges and the left and right sidewalls (I).

Referring to FIG. 11, rounded edges 151,152,153,161, 162,163 are formed in all hair receiving areas along the left and right sidewalls 141, 142, and the bottom walls 143, of the notches 14 for supporting the hair not to be cut H1 during trimming. In a second embodiment, referring to FIG. 12, rounded edges 171 are also formed on intersection of the cutting edges 17 and the sidewalls 141,142.

As indicated above, by means of the rounded edges 151~153, 161~163, 171, the hair not to be cut H1 being received in the notches 14 and the hair receiving space C is maintained in "sliding" contact with the rounded edges 151~153, 161~163, 171, and therefore the hair not to be cut H1 can smoothly be moved away from the thinning scissors B without damage during trimming.

Although a particular embodiment of the invention has been described in detail for purposes of illustration, various modifications and enhancements may be made without departing from the spirit and scope of the invention.

The invention claimed is:

1. A notched single-edge thinning scissors comprising a first scissors member having a handle at one end thereof and a blade at an opposite end thereof, said blade having a contact side, a distal side opposite to said contact side, and a notched edge formed of teeth and notches, said teeth each having a cutting edge;

a second scissors member having a handle at one end thereof and a blade at an opposite end thereof, said blade of said second scissors member having a cutting side and a distal side opposite to said cuffing side, said notches of the blade of said first scissors member defining with the leading edge of the blade of said second scissors member a hair receiving space, each said notch having a left sidewall, a right sidewall, and a bottom wall; and a pivot, pivotally connecting said first scissors member and said second scissors member;

wherein the contact side and the distal side of the blade of said first scissors member each have first rounded edges, second rounded edges and third rounded edges respectively connected to the left sidewall, the right sidewall and the bottom wall of each said notch.

2. The notched single-edge thinning scissors as claimed in claim 1, wherein the blade of said first scissors member further has rounded edges formed along the intersection between said cutting edges of said teeth and the left and right sidewalls of each of said notches.

* * * * *